US005207428A

United States Patent [19]

Aizawa

[11] Patent Number: 5,207,428

[45] Date of Patent: May 4, 1993

[54] GOLF CLUB HEAD

[75] Inventor: Yuichi Aizawa, Tokyo, Japan

[73] Assignee: Daiwa Golf Co., Ltd., Tokyo, Japan

[21] Appl. No.: 810,285

[22] Filed: Dec. 19, 1991

[30] Foreign Application Priority Data

Jan. 21, 1991 [JP] Japan ..... 3-1345[U]

[51] Int. Cl.[5] ..... A63B 53/04

[52] U.S. Cl. ..... 273/174; 273/167 H; 273/DIG. 23

[58] Field of Search ..... 273/167-175, 273/DIG. 23, 80 R, 80.1-80.8, 77 R

[56] References Cited

U.S. PATENT DOCUMENTS

| | | | |
|---|---|---|---|
| 3,002,757 | 10/1961 | Marciniak | 273/174 |
| 3,640,534 | 2/1972 | Mills | 273/174 X |
| 4,451,041 | 5/1984 | Hayashi et al. | 273/167 H |
| 4,756,534 | 7/1988 | Thompson | 273/167 H X |
| 4,874,171 | 10/1989 | Ezaki et al. | 273/167 H X |
| 5,080,366 | 1/1992 | Okumoto et al. | 273/167 A X |

FOREIGN PATENT DOCUMENTS

| | | | |
|---|---|---|---|
| 62-170271 | 7/1987 | Japan . | |
| 3005768 | 1/1988 | Japan | 273/167 R |
| 63-071272 | 3/1988 | Japan . | |
| 0409233 | 1/1991 | Japan | 273/167 H |
| 376903 | 7/1932 | United Kingdom | 273/167 R |
| 397252 | 8/1933 | United Kingdom | 273/167 R |
| 2156688 | 10/1985 | United Kingdom | 273/167 A |
| 2225725 | 6/1990 | United Kingdom | 273/167 H |

*Primary Examiner*—V. Millin
*Assistant Examiner*—Sebastiano Passaniti
*Attorney, Agent, or Firm*—Longacre & White

[57] ABSTRACT

Disclosed is a golf club head which comprises: a head body constituted by a core material coated with a layer of fiber-reinforced resin, such as carbon-fiber-reinforced resin, glass-fiber-reinforced resin, or the like; and a sole plate attached to a sole portion of the head body, the sole plate having a protrusion being buried in the head body and projecting outward beyond a peripheral edge of the sole plate; whereby the protrusion may bite into the head body even if a large force is exerted to a head by a shock at the time of a shot so that the sole plate is positively prevented from peeling off from the head body, and the weight of the protrusion portion is added to the periphery of the head body to thereby make the moment of inertia of the head high.

14 Claims, 3 Drawing Sheets

GOLF CLUB HEAD

BACKGROUND OF THE INVENTION present invention generally relates to golf club heads and particularly relates a golf club head aiming at prevention of its sole plate from peeling off from its head body and an improvement of its impact property.

Recently, there has been proposed a golf club called a "wood" having a head body which is made by compression-forming a layer of fiber-reinforced resin, such as carbon-fiber-reinforced resin, glass-fiber-reinforced resin, or the like, on a surface of a core material made of foam synthetic resin or the like, as a substitute for making the head body out of natural wood such as wood of a kaki tree or Japanese persimmon tree, wood of a cherry tree, or the like, in the viewpoints of stability of quality, easiness in supply of materials, and so on. At a sole portion of such a head body, a sole plate made of aluminum, brass or the like is attached.

Conventionally, such a sole plate is inserted together with a material for forming a head body into a cavity of a mold and integrally thermally pressed so that the sole plate is attached to the head body. Further, recently, as disclosed, for example, in Japanese Patent application (OPI) No. Sho-62-170271 (the term "OPI" as used herein means an "unexamined published application"). A protrusion (or a sole plate support pin) having a substantially T-shaped section is provided on a sole plate so that the protrusion projects into a head body to aim at prevention of the sole plate from peeling off by means of the protrusion. Further, Japanese Patent Application (OPI) No. Sho-63-71272 discloses a golf club head of carbon iron having a structure in which a protrusion is provided on a sole plate so as to project up from the sole plate into a head body.

In such a conventional structure as disclosed in the Japanese Patent Application (OPI) No. Sho-62-170271, however, there has been a problem that the weight of the protrusion is added to the inside of the golf club head so as to reduce the moment of inertia to thereby lower the impact property because the protrusion is T-shaped in section so that the ends of the protrusion project not only to the outside of the head body but to the inside of the same, while the sole plate can be surely prevented from peeling off because of the T-shaped section of the protrusion. Further, in the latter conventional structure disclosed in the Japanese Patent Application (OPI) No. Sho-63-71272, there has been a problem that the prevention of peeling-off of the sole plate from the head body is not sufficient.

SUMMARY OF THE INVENTION

It is therefore an object to solve the above problems in the conventional structures.

It is another object of the present invention to provide a golf club head aiming at sure prevention of its sole plate from peeling off from its head body and an improvement of its impact property.

In order to attain the above objects, according to an aspect of the present invention, provided is a golf club head which comprises: a head body constituted by a core material the surface of which is covered with a layer of fiber-reinforced resin, such as carbon-fiber-reinforced resin, glass-fiber-reinforced resin, or the like; and a sole plate attached to a sole portion of the head body, the sole plate having a protrusion being buried in the head body and projecting outward beyond a peripheral edge of the sole plate.

According to the present invention, even if a large force is exerted to a golf club head by a shock at the time of a shot, the protrusion bites into the head body so that the sole plate is positively prevented from peeling off from the head body. Further, since the protrusion projects outward beyond the peripheral edge of the sole plate, the weight of the protrusion is added to the periphery of the head body to thereby increase the moment of inertia of the golf club head.

DETAILED DESCRIPTION OF THE PREFERRED EMBODIMENTS

Figure 1:
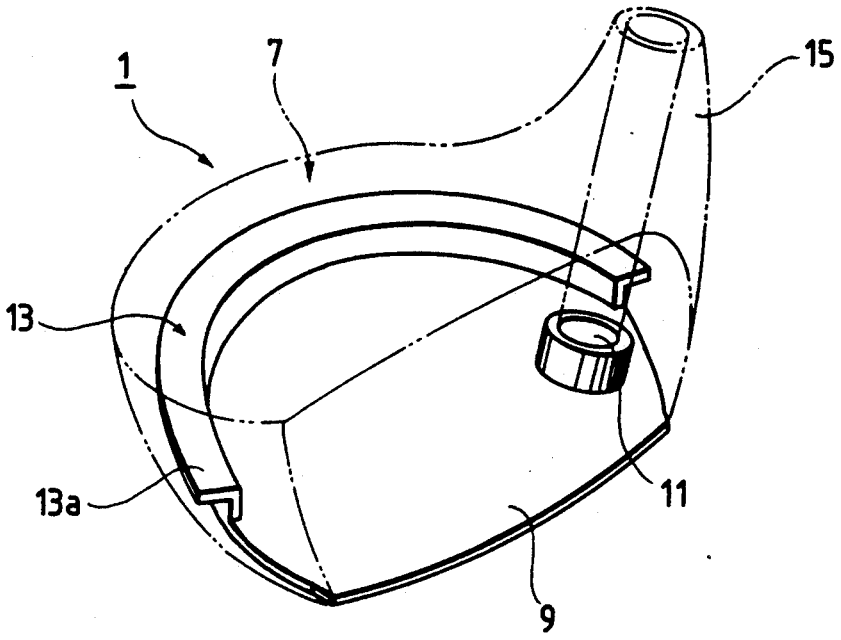
FIG. 1 is a perspective view of a first embodiment of the head according to the present invention.

Referring to the drawings, the preferred embodiments of the present invention will be described in detail hereunder.

Figure 2:
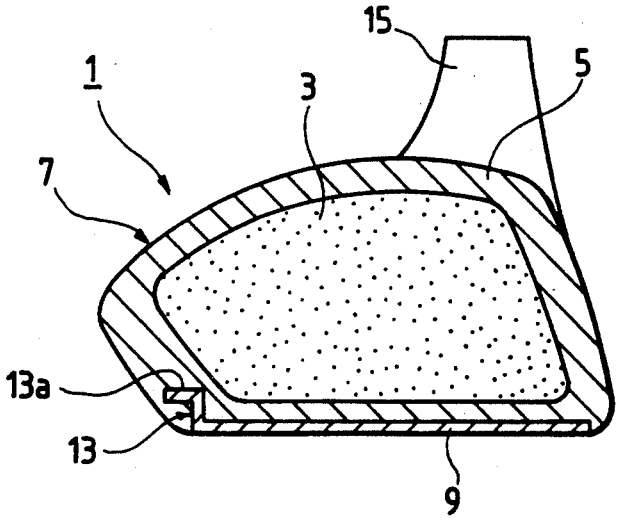
FIG. 2 is a section of the head shown in FIG. 1.

FIGS. 1 and 2 show a first embodiment of the present invention. In FIGS. 1 and 2, the reference numeral 1 designates a golf club head (hereinafter simply referred to as "head") called a "wood", which comprises: a head body 7 constituted by a core material 3 of foam synthetic resin or the like the surface of which is coated with a layer 5 of fiber-reinforced resin, such as carbon-fiber-reinforced resin, glass-fiber-reinforced resin, or the like; and a sole plate 9 attached to a sole portion of the head body, similarly to the conventional wood made of fiber-reinforced resin.

The sole plate 9 is made of a metal such as aluminum, brass or the like, synthetic resin, ceramic, or any combination thereof. A fixing protrusion 11 for receiving an end of a shaft passed through the head body 7 fitted thereto. A protrusion 13 is formed integrally with the sole plate 9 so as to extend from a heel portion to a toe portion through a back side along the peripheral edge of the sole plate 9. As shown in FIG. 2, the protrusion 13 is projected upward from the upper surface of the sole plate 9 and bent outward at its intermediate position so as to form a collar portion 13*a* which projects outward beyond the peripheral edge of the sole plate 9. Thus, by making the collar portion 13*a* of the protrusion 13 project outward beyond the peripheral edge of the sole plate 9, the weight of the protrusion 13 is added to the periphery of the head body 7 to thereby increase the moment of inertia.

The sole plate 9 is attached to the head body 7 through a process in which the sole plate 9 is inserted together with a material for forming the head body 7 into a cavity of a mold and heat-pressed so as to be integrated with the head body forming material. The protrusion 13 is buried within the fiber-reinforced resin layer 5 of the head body 7. Further, in the drawing, the reference numeral 15 designates a hosel portion formed by raising the fiber-reinforced resin layer 5.

Thus, in this embodiment, the protrusion 13 is formed integrally with the sole plate 9 along the peripheral edge of the latter so as to extend from the heel portion to the toe portion through the back side and buried in the fiber-reinforced resin layer 5, and the protrusion 13 has an L-like section so as to form the collar portion 13*a* which projects outward beyond the peripheral edge of the sole plate 9. Accordingly, even if a large force is exerted to the head 1 by a shock at the time of a shot, the protrusion 13 bites into the head body 7 so that the sole plate 9 is positively prevented from peeling off from the fiber-reinforced resin layer 5. Further, as described above, since the collar portion 13*a* of the protrusion 13 projects out ward beyond the peripheral edge of the sole plate 9, the weight of the protrusion 13 is added to the periphery of the head body 7 to thereby increase the moment of inertia of the head 1.

According to this embodiment, therefore, the peeling-off of the sole plate 9 from the head body 7 due a shock at the time of a shot is prevented, and, as a result, damage of the head 1 due to a shock at the time of a shot is surely prevented and at the same time the moment of inertia of the head 1 is made so higher than the conventional cases that the head speed is increased to thereby improve the impact property.

Figure 3:
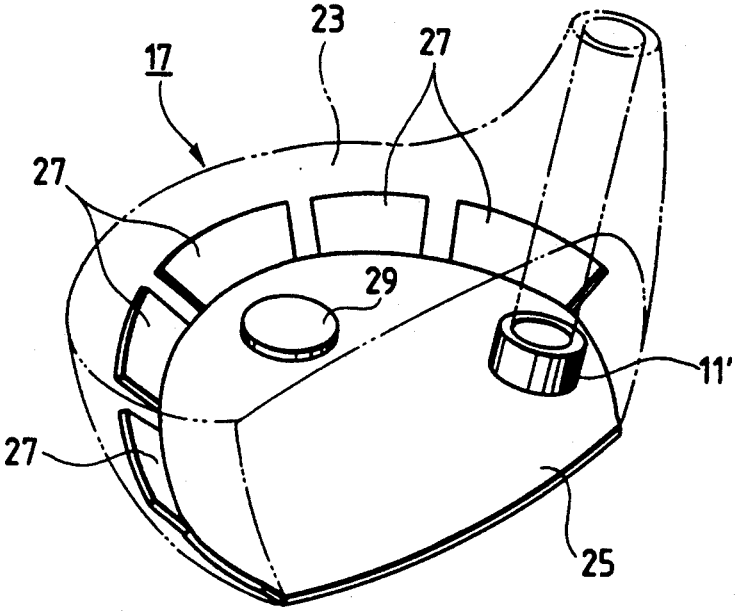
FIG. 3 is a perspective view of a second embodiment of the head according to the present invention.
Figure 4:
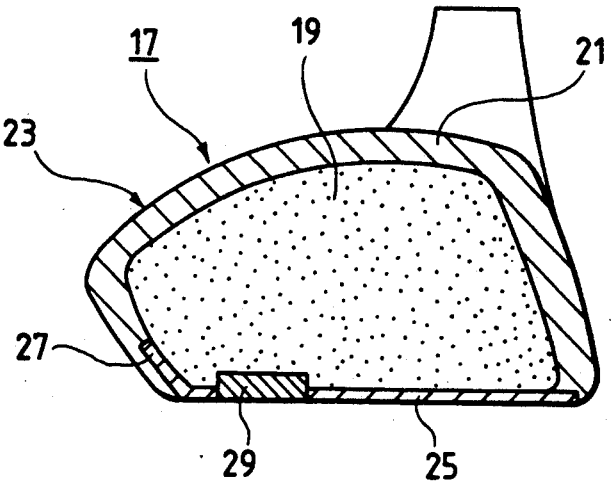
FIG. 4 is a section of the head shown in FIG. 3.

FIGS. 3 and 4 show a second embodiment of the present invention. In the drawings, the reference numeral 17 designates a head according to this embodiment. Similarly to the head 1 in the first embodiment, the head 17 is constituted by a head body 23 and a sole plate 25 attached to a sole portion of the head body 23. The head body 23 is formed through a process in which a surface, excepting the sole portion, of a core material 19 made of foam synthetic resin or the like is coated with a layer 21 of fiber-reinforced resin.

The sole plate 25 is made of the same material as that of the foregoing sole plate 9 of the first embodiment, and a fixing protrusion 11' for making an end of a shaft passed through the head body 23 fit thereto is provided on the upper surface of the sole plate 25. Five tongue-like protrusion portions 27 are formed in row integrally with the sole plate 25 at the peripheral edge thereof so that the tongue-like protrusion portions 27 are even in height and each obliquely projected from the peripheral edge of the sole plate 25. The row of tongue-like protrusion portions 27 are arranged so as to extend from a heel portion to a toe portion through a back side.

The protrusion portions 27 are successively arranged between the fiber-reinforced resin layer 21 and the core material 19 with slight intervals along the respective shapes of heel, back and toe portions along the outer configuration of the head body 23. By the provision of the five tongue-like protrusion portions 27 projecting obliquely beyond the peripheral edge of the sole plate 25, the weight of the protrusion portions 27 is added to the periphery of the head body 23 to thereby make the moment of inertia of the head 17 high. In the same manner as in the conventional one, the sole plate 25 is attached to the head body 23 through a process in which the sole plate 9 is inserted together with a material for forming the head body 23 into a cavity of a mold and heat-pressed so as to be integrated with the head body forming material. Further, in the drawing, the reference numeral 29 designates a balancer for adjusting the balance of the head 17. The balancer 29 may be attached through a proper manner.

Thus, in the second embodiment, the five tongue-like protrusion portions 27 projecting obliquely outward beyond the peripheral edge of the sole plate 25 are successively arranged so as to be buried in between the fiber-reinforced resin layer 21 and the core material 19 and so as to extend along the heel, back and toe portions of the sole plate 25. Accordingly, even if a large force is exerted to the head 17 by a shock at the time of a shot, the protrusion portions 27 bite into the head body 23 so that the sole plate 25 is positively prevented from peeling off from the head body 23. Further, since the protrusion portions 27 project outward beyond the peripheral edge of the sole plate 25, the weight of the protrusion portions 27 is added to the periphery of the head body 23 to thereby make the moment of inertia of the head 17 high.

Thus, also according to the second embodiment, the peeling-off of the sole plate 25 from the head body 23 due a shock at the time of a shot is prevented, and, as a result, damage of the head 1 due to the a shock at the time of a shot is surely prevented, and at the same time the moment of inertia of the head 17 is made so higher than the conventional cases that the head speed is increased to thereby improve the impact property.

Figure 5:
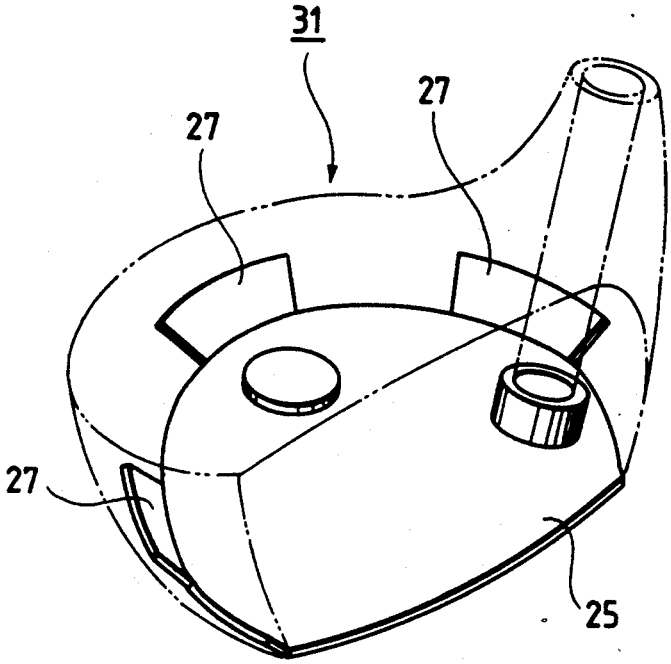
FIG. 5 is a perspective view of a third embodiment of the head according to the present invention.

Though the case where the five tongue-like protrusion portions 27 are arranged successively along the peripheral edge of the sole plate 25 has been described in the second embodiment, the number and intervals of the protrusion portions are not limited to this embodiment but may be suitably chosen according to the necessity. For example, as illustrated in the third embodiment shown in FIG. 5, three tongue-like protrusion portions 27 projecting obliquely outward beyond the peripheral edge of a sole plate 25 may be provided with regular intervals along the peripheral edge of the sole plate 25 from the heel portion to the toe portion through the back portion so that the protrusion portions 27 are buried in between a fiber-reinforced resin layer 21 and a core material 19. Also in a head 31 having such a configuration, it is possible to achieve the expected objects, similarly to the foregoing embodiments.

Figure 6:
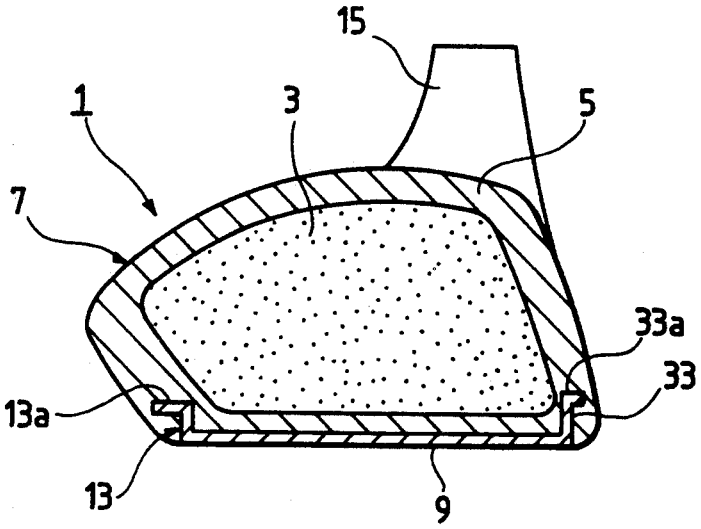
FIG. 6 is a section of a third embodiment of the head according to the present invention.

FIG. 6 shows a third embodiment of the present invention. In this embodiment, a protrusion 33 is formed to the sole plate 9 in a face side portion of the head 1 along the peripheral edge of the sole plate 9. As shown in FIG. 6, the protrusion 33 is projected upward form the upper surface of the sole plate 9 and bent outward at its intermediate position so as to form a collar portion 33*a* which projects outward beyond the periphery edge of the sole plate 9.

According to this embodiment, the face of the head is reinforced by means of the protrusion 33 so that the face is efficiently prevented from being damaged due to an impact between the ball and the head or a shock caused by a contact between the head and the ground at the time of shot.

Though the description has been made as the embodiments in which the protrusion 13, 33 and the protrusion portions 27 are provided integrally with the sole plates 9 and 25 respectively, the protrusion 13, 33 and the protrusion portions 27 may be provided separately from the sole plates 9 and 25 respectively and attached to the respective sole plates by fusion or through adhesion.

According to the present invention, the following advantages can be obtained.

Since a sole plate is provided with a protrusion which projects outward beyond a peripheral edge of the sole plate and which is buried in a head body, the protrusion may bite into the head body even if a large force is exerted to a head by a shock at the time of a shot so that the sole plate is positively pre vented from peeling off from the head body. Further, since the protrusion projects outward beyond the peripheral edge of the sole plate, the weight of the protrusion portion is added to the periphery of the head body to thereby make the moment of inertia of the head high.

Preferably, the sole plate is provided with a fitting portion in which an end of a shaft may be fitted so that the sole plate is combined with a shaft in addition to the combination with the head body through the protrusion, so that the peeling-off of the sole plate from the head body can be prevented more surely.

Preferably, the protrusion may be formed so as to extend from a heel portion to a toe side through a back side over a wide range of the sole plate, so that the peeling-off of the sole plate from the head body can be prevented efficiently.

Preferably, the protrusion may be bent outward so that the protrusion strongly bites into the head body to thereby make the combination of the sole plate with the head body strong.

Preferably, the protrusion may include a plurality of protrusion portions separated at intervals from each other, that is, the number of the protrusion is changed so that the weight distribution of the head is changed, to thereby make it possible to adjust the balance.

Preferably, the protrusion may be projected obliquely out ward beyond the peripheral edge of the sole plate along the outer configuration of the head body, so that the weight is added to the periphery of the head body to thereby make the moment of inertia higher.

Preferably, the protrusion may be buried in the layer of fiber-reinforced resin of the head body, so that the protrusion is held by the fiber-reinforced resin so firmly that the peeling-off of the sole plate from the head body can be prevented and the fiber-reinforced resin layer on the periphery of the sole plate is reinforced.

Preferably, the protrusion may be buried in between the core material and the fiber-reinforced resin layer of the head body, so that the vibration of the sole plate can be absorbed by the core material.

Preferably, the protrusion may be formed integrally with the sole plate, so that the protrusion is made so high in mechanical strength as to be hardly damaged.

Preferably, the protrusion may be formed separately from the sole plate and attached to the sole plate by fusion or through adhesion to thereby increase the degree of freedom.

What is claimed is:

1. A golf club head comprising:

a head body comprising a core member and a fiber-reinforced resin layer, said core member being coated with said fiber-reinforced resin layer, said head body having a sole portion, heel portion, toe portion, a back side portion, and a face side portion; and a sole plate attached to the sole portion of said head body, said sole plate lying in a plane and bounded in said plane by a peripheral edge, said sole plate having a protruded member being encapsulated in said head body and projecting radially beyond said peripheral edge of said sole plate.

2. A golf club head according to claim 1, wherein said sole plate has a fitting portion in which an end of a shaft is fitted.

3. A golf club head according to claim 1, wherein said protruded member extends from the heel portion to the toe portion through the back side portion.

4. A golf club head according to claim 1, wherein said protruded member is formed to bend radially outwardly with respect to an end portion of said sole plate.

5. A golf club head according to claim 1, wherein said protruded member includes a plurality of protrusions separated at intervals from each other.

6. A golf club head according to claim 1, wherein said protruded member is projected obliquely and outwardly beyond the peripheral edge of said sole plate.

7. A golf club head according to claim 1, wherein said protruded member is buried in said fiber-reinforced resin layer of said head body.

8. A golf club head according to claim 1, wherein said protruded member is contiguously encapsulated by said core member and said fiber-reinforced resin layer of said head body.

9. A golf club head according to claim 1, wherein said protruded member is formed integrally with said sole plate.

10. A golf club head according to claim 1, wherein said protruded member projects toward the face side portion.

11. A golf club head according to claim 1, wherein said protruded member extends from the heel portion to the toe portion and projects toward the back side portion and the face side portion.

12. A golf club head according to claim 1, wherein said protruded member is formed separately from said sole plate and attached to said sole plate.

13. A golf club head according to claim 12, wherein said protruded member is attached to said sole plate by adhesion.

14. A golf club head according to claim 12, wherein said protruded member is attached to said sole plate by fusion.

* * * * *